United States Patent [19]

Vermeulen

[11] Patent Number: 4,999,931

[45] Date of Patent: Mar. 19, 1991

[54] SHOCK ABSORBING SYSTEM FOR FOOTWEAR APPLICATION

[76] Inventor: Jean-Pierre Vermeulen, 2489 Queen St. E., Toronto, Ontario, Canada, M4E 1H9

[21] Appl. No.: 312,729

[22] Filed: Feb. 21, 1989

[30] Foreign Application Priority Data

Feb. 24, 1988 [CA] Canada ..... 559716

[51] Int. Cl.[5] ..... A43B 13/20

[52] U.S. Cl. ..... 36/29; 36/30 R; 36/44; 128/594

[58] Field of Search ..... 36/29, 44, 32 R, 28, 36/35 B; 128/594

[56] References Cited

U.S. PATENT DOCUMENTS

| | | | |
|---|---|---|---|
| 1,145,533 | 7/1915 | Wetmore | 128/594 |
| 1,504,908 | 8/1924 | Sato | 128/594 |
| 2,090,881 | 8/1937 | Wilson | 36/29 |
| 4,340,626 | 7/1982 | Rudy | 36/29 |
| 4,451,994 | 6/1984 | Fourer | 36/29 |
| 4,753,021 | 6/1988 | Cohen | 36/28 |
| 4,798,009 | 1/1989 | Colonel et al. | 36/29 |
| 4,843,735 | 7/1989 | Nakanishi | 36/29 |

FOREIGN PATENT DOCUMENTS

| | | | |
|---|---|---|---|
| 712134 | 6/1965 | Canada | 154/117 |
| 416723 | 3/1924 | Fed. Rep. of Germany | 36/29 |
| 341490 | 4/1904 | France | 36/29 |
| 2206475 | 1/1989 | United Kingdom | 36/29 |

*Primary Examiner*—Steven N. Meyers

*Attorney, Agent, or Firm*—Riches, McKenzie & Herbert

[57] ABSTRACT

This invention relates to a new shock absorber which may be used as an insole or as a midsole for an article of footwear. The shock absorber comprises a multi-cell membrane which may be embedded in a flexible envelope or which may be used itself as a one-piece multi-cell membrane insole or midsole. The shock absorber exhibits improved shock absorbing characteristics which increases the comfort of the wearer of the shoes and reduces damage to the foot during athletic exercises.

8 Claims, 8 Drawing Sheets

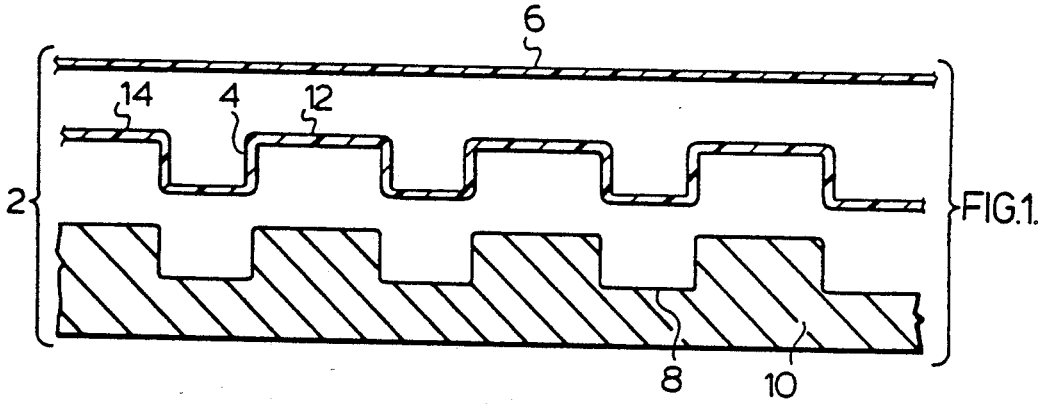
FIG.1.
FIG.2.
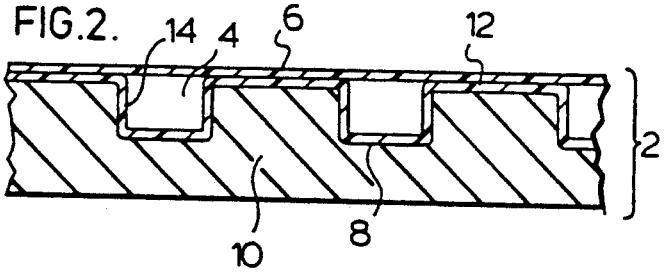
FIG.3.
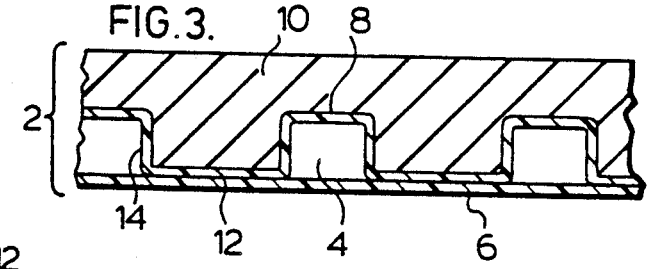
FIG.4.
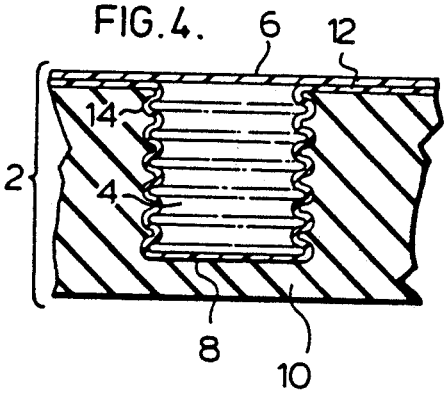
FIG.5.
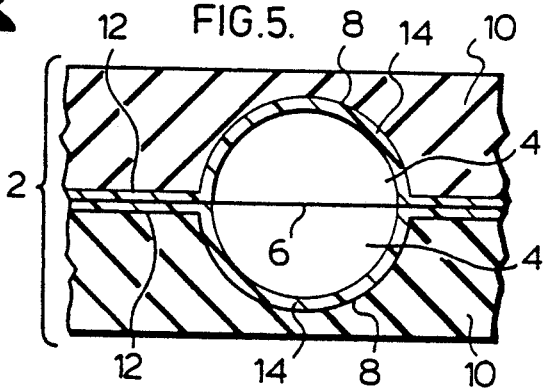

FIG.8.B.

SHOCK ABSORBING SYSTEM FOR FOOTWEAR APPLICATION

BACKGROUND OF THE INVENTION

1. Field of the Invention

This invention relates to a new shock absorbing material and more particularly to a new shock absorber which may be used as an insole or as a midsole for an article of footwear.

The new shock absorber comprises a multi-cell membrane which may be used as an insole or a midsole or which may be embedded in a flexible envelope which is then used as a midsole or an insole.

2. Description of the Prior Art

For ease of reference, the following description of the prior art as well as the description of the preferred embodiment of the invention will be made with reference to a shoe, as a specific article of footwear. It is to be understood that the present invention is applicable to all forms of footwear, such as shoes, boots, skates and the like and is not restricted to any type of footwear.

In the past, various attempts have been made to design a shock absorbing structure for use in shoes which directly increases the comfort of the wearer and reduces damage to the foot during athletic exercises.

These devices tended to increase the shock absorbing and functional support characteristics of the shoe and included inserts, shock absorbing layers, gas-inflated midsoles and the like. These devices generally were attached to a shoe or inserted directly into the shoe.

Synthetic rubber and other elastomeric materials used as an integral part of a shock absorbing device are well known and in widespread use. For example, Dupont Company's Hytrel (trade mark) 4056 is widely used as a material from which cushion insoles are made. For example, the "Bostonian Golf Shoe" uses an insole of about 3/16" in thickness which has been molded into a block and cut to shape.

While such insoles have significantly helped to reduce stress and discomfort experienced during walking or running, they did not provide to any great degree, the required shock absorbing characteristics without increasing the inner sole thickness to an unacceptable amount.

Other ideas have been suggested which involve the manufacture of an insert for use as a part of a shoe or for use as an insole to be inserted into existing footwear. One such idea is disclosed in Canadian patent No. 1,099,506 issued on Apr. 4, 1981 to Rudy. This patent discloses the use of a membrane consisting of a plurality of interconnected, intercommunicable chambers which are inflated with a large molecule gas as an inflating medium to produce the desired cushioning effect While this invention provides shock absorbency, it has three serious drawbacks. First, as the inflation medium shifts between the chambers, the antero/posterior and mediolateral stability is compromised to the point of creating a severe wobbling effect which could lead to a serious injury. Secondly, in the case of a heavier person, the inflating medium (gas) will shift from the heel portion to the forward portion of the shoe during walking. This will result in a bottoming out phase which may be a direct cause of heel spurs, severe knee problems or other serious injury. The third drawback is obviously that any anomaly or leak in any one of the chambers leads directly to a failure of the entire system since the channels communicate with each other.

Another system based on different principles is shown in U.S. Pat. No. 4,535,553 granted to Nike, Inc. The invention disclosed in this patent shows a shock absorbing layer encased in an elastomeric foam. This sole layer insert comprises many transversely and longitudinally spaced projections which act as a shock absorber.

A further solution is that proposed in my Canadian patent No. 1,084,260 issued on Aug. 26, 1980. This patent discloses an improved shoe sole containing discrete air chambers which helped to overcome or reduce injuries suffered by athletes during the performance of athletic activities. My invention provided the required shock absorbency of an air cushion system, the stability of an independent air chamber shoe sole and resiliency to the shoe. The use of discrete air chambers disclosed in my prior patent is particularly useful as an integral part of a shoe such as a midsole, but it is not practical to use it as an accessory for existing footwear.

SUMMARY OF THE INVENTION

It is an object of the present invention to at least partially overcome these disadvantages and to provide a new and improved shock absorber which may be used as an insole or as a midsole for an article of footwear.

It is a further object of the present invention to provide a new shock absorber for use as a midsole or as an insole for an article of footwear, the shock absorber comprising a multi-cell membrane which has been embedded in a flexible envelope.

Another object of the present invention is to provide a new shock absorber for use as a midsole or as a insole for an article of footwear, the shock absorber comprising a multi-cell membrane which is used directly as the midsole or the insole.

A still further object of the present invention is to provide a new and improved midsole for use with an article of footwear.

Another object of the invention is to provide a new and improved insole for use in an article of footwear.

Another object of the present invention is to provide a shoe having improved shock absorbing characteristics.

To this end, in one of its aspects, the invention provides a shock absorber for use in association with an article of footwear, the shock absorber comprising a multi-cell membrane embedded in a flexible envelope.

In another of its aspects, the invention provides a shock absorber for use in association with an article of footwear, the shock absorber comprising a multi-cell membrane.

In another of its aspects, the invention provides an insole for use in a shoe, said insole comprising a synthetic elastomeric rubber membrane consisting of a plurality of independent and non-communicating cells, each cell containing air at ambient temperature and pressure, said cells connected to one another by an interconnector, said membrane embedded in a flexible envelope of a material selected from the group consisting of foam, cross-linked polyethylene, ethyl vinyl acetate, polyurethane, elastomeric foam material, or synthetic rubber material, said flexible envelope having a plurality of receptacles, each receptacle adapted to receive one of the cells therein.

In yet another of its aspects, the invention provides a midsole for use in a shoe, said midsole comprising a synthetic rubber membrane consisting of a plurality of independent, non-communicating cells, each cell containing air at ambient temperature and pressure, the cells connected by an interconnector, the membrane embedded in a flexible envelope of a material selected from the group consisting of foam, crosslinked polyethylene, ethyl vinyl acetate, polyurethane, elastomeric foam material or synthetic rubber material, the flexible envelope having a plurality of receptacles, each receptacle adapted to receive one of said cells therein.

In another of its aspects, the invention provides a shock absorber for use in association with an article of footwear, the shock absorber comprising a multi-cell membrane.

In another of its aspects, the invention provides an insole for use in a shoe, said insole comprising a synthetic elastomeric rubber membrane consisting of a plurality of independent and noncommunicating cells, each cell containing air at ambient temperature and pressure, said cells connected to one another by an interconnector.

In yet another of its aspects, the invention provides a midsole for use in a shoe, said midsole comprising a synthetic rubber membrane consisting of a plurality of independent, non-communicating cells, each cell containing air at ambient temperature and pressure, the cells connected by an interconnector.

Other objects and advantages of the present invention will appear from the following description taken together with the accompanying drawings.

BRIEF DESCRIPTION OF THE DRAWINGS

FIG. 1 is an exploded, sectional view of a part of a shock absorber of the present invention.

FIG. 2 is a sectional view of a part of the assembled shock absorber of FIG. 1.

FIG. 3 is a sectional view of a part of the assembled shock absorber of a second embodiment of my invention.

FIG. 4 shows one embodiment of a shape for a cell of the membrane of the shock absorber.

FIG. 5 shows another embodiment for a cell of the membrane of the shock absorber

FIGS. 8A to 8C illustrate the steps in producing the multi-cell membrane of the present invention.

(FIG. 9 appears on the same page as FIG. 6).

(FIG. 10 appears on the same page as FIG. 6)

(FIG. 11 appears on the same page as FIG. 6)

Figures 12, 13:
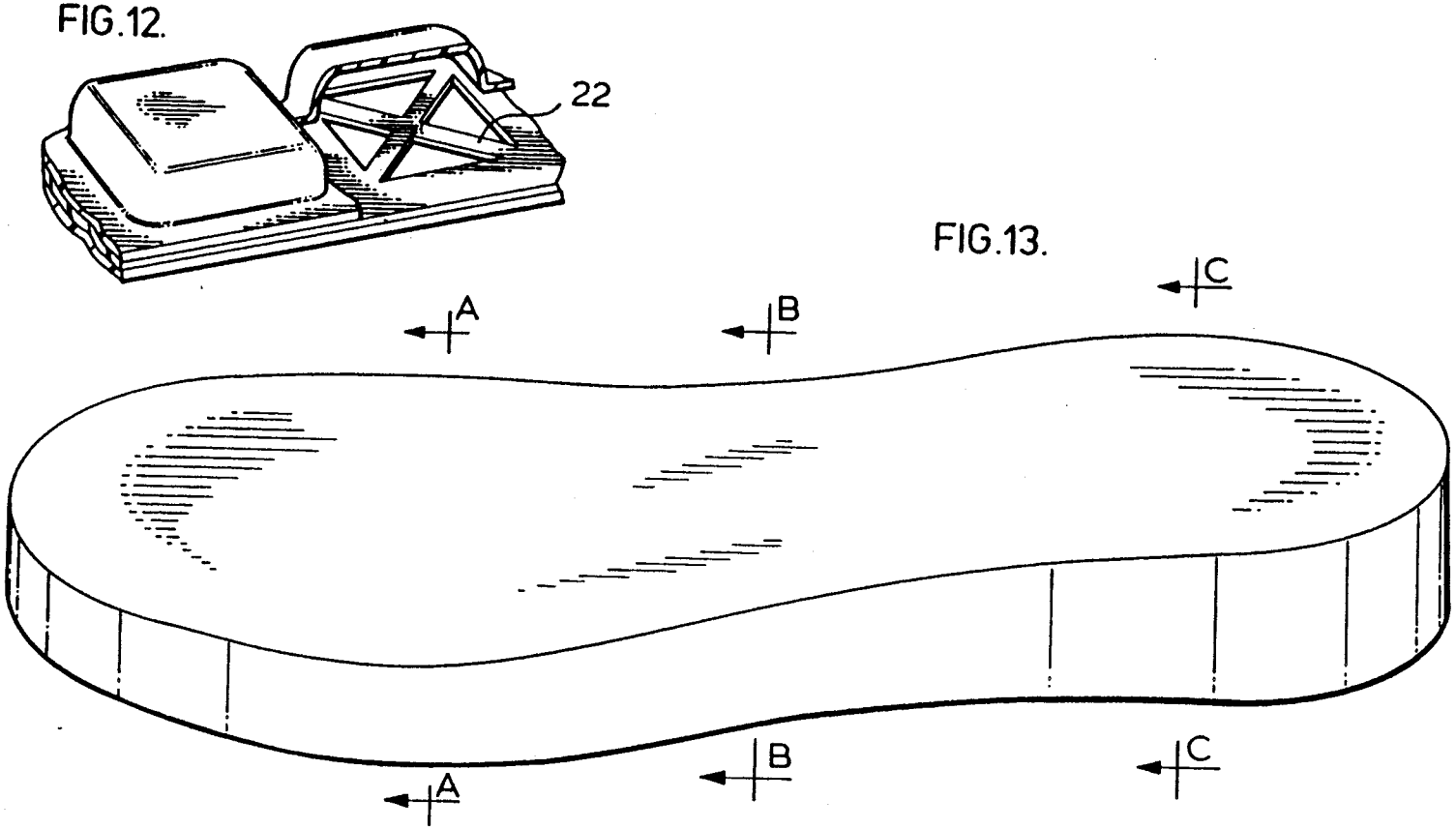
FIG. 12 is a sectional view of one cell showing another embodiment of the cell structure.
FIG. 13 is a schematic diagram of a shoe sole to illustrate placement of the new shock absorbing material.

FIG. **14*a* is a sectional view along line A—A of FIG. 13**.

FIG. **14*b* is a sectional view along line B—B of FIG. 13**.

FIG. **14*c* is a sectional view along line C—C of FIG. 13**.

FIG. **14*d* is a sectional view of a second embodiment along line A—A, B—B or C—C of FIG. 13**.

FIG. **14*e* is a sectional view of a third embodiment along line A—A, B—B, or C—C of FIG. 13**.

Figure 15:
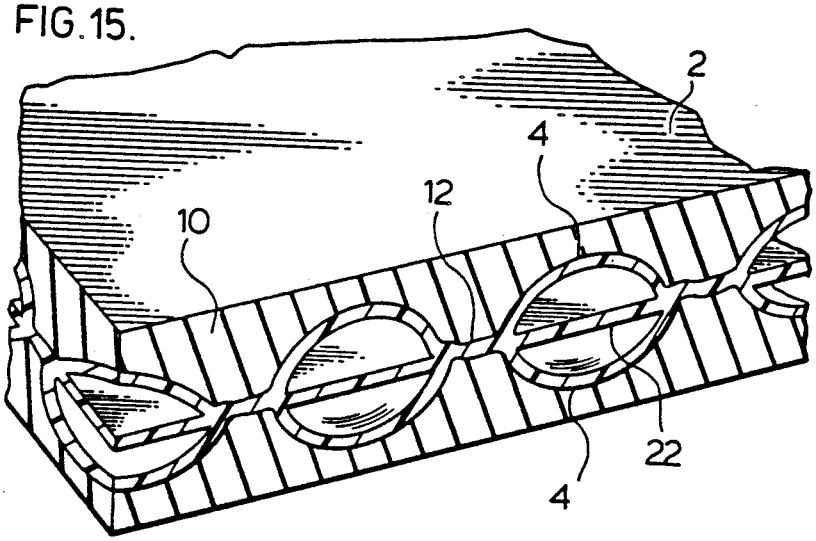

FIG. 15 is a sectional view of a preferred embodiment of the present invention.

Figure 16:
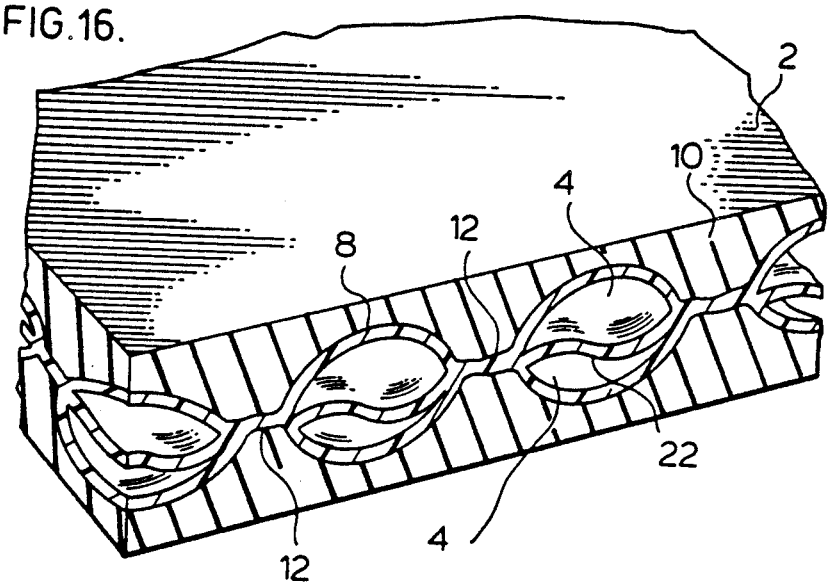

FIG. 16 is a sectional view of a second preferred embodiment of the present invention.

Figure 17:
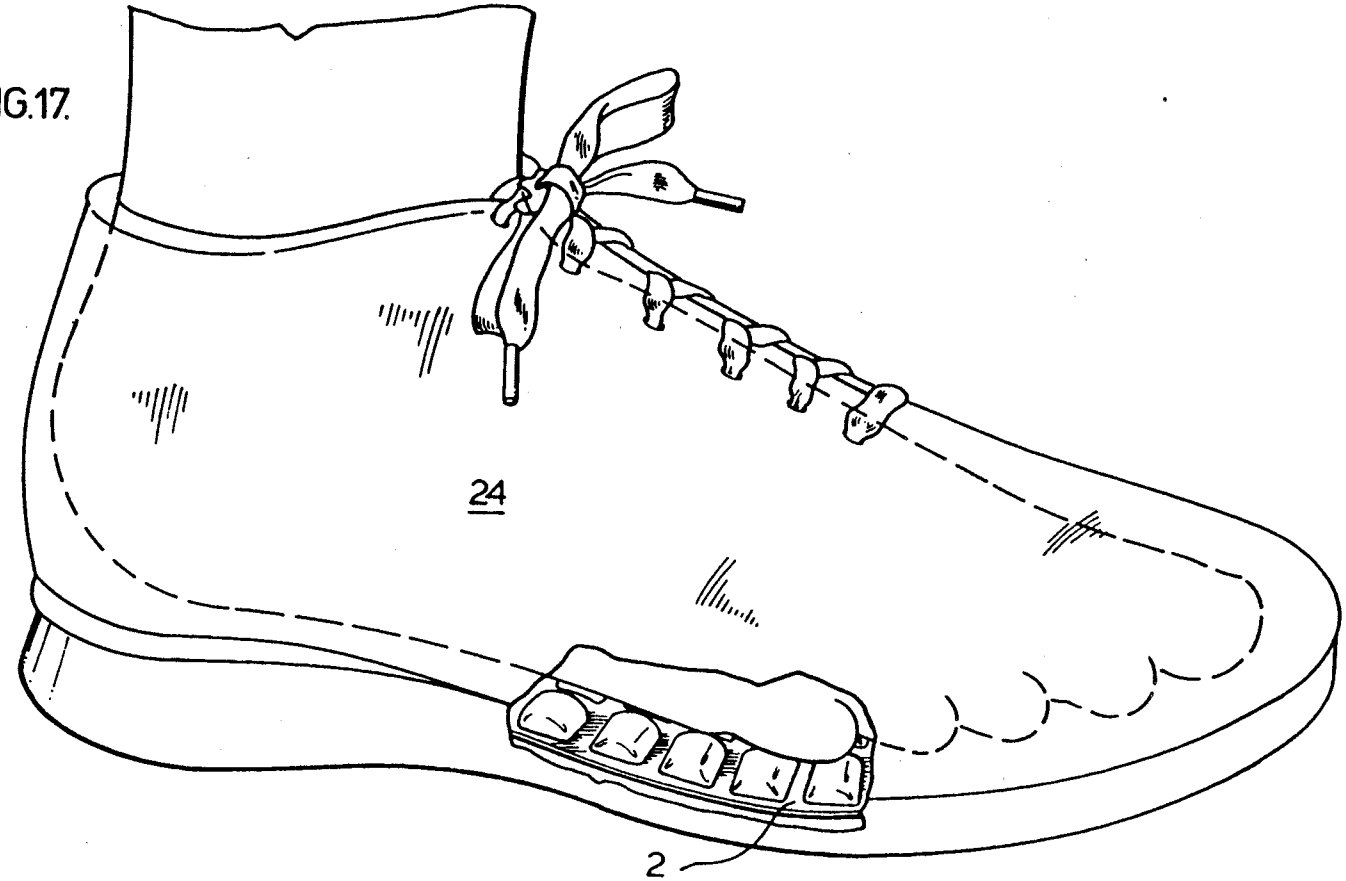

FIG. 17 is a partially sectional view of a shoe having the present invention embedded therein.

DESCRIPTION OF THE PREFERRED EMBODIMENT

The present invention relates to a new concept in footwear and specifically, to a new shock absorber which comprises a new multi-cell membrane which may or may not be embedded in a flexible envelope, to be used in a midsole or insole of a shoe.

The shock absorber comprises a multicell membrane which comprises a plurality of noncommunicating, independent cells, each cell containing air entrapped therein at ambient temperature and pressure. The cells are distributed about the membrane to fit the specific article of footwear and the membrane itself may be embedded in a flexible envelope designed to fit the inside of the shoe.

The multi-membrane may be used itself either as an integral part of the shoe or as an accessory such as a removable insole sold apart from the shoe. The membrane may be used as a midsole incorporated directly into the shoe, as an insole sold as a removeable accessory to the shoe or as a membrane embedded in the flexible envelope which then is used as a midsole or as an insole of the shoe.

The following description is first made of the multicell membrane which is embedded in a flexible envelope.

FIG. 1 shows an exploded, sectional view of a part of the new shock absorber The shock absorber generally indicated as 2 comprises a membrane 14 having a plurality of independent cells 4 and interconnector 12, sealing member 6, and flexible envelope 10 which carries a plurality of receptacles 8 which correspond in shape, design and size to cells 4.

Thus as shown in FIG. 2, the shock absorber 2 is formed by the membrane 14 embedded into envelope 10. The membrane 14 comprises a plurality of discrete cells 4, each sealed by sealing member 6 and joined by interconnector 12. Each cell 4 fits within a receptacle 8 in envelope 10.

FIG. 3 shows an alternate embodiment to FIG. 2. In FIG. 3, the cells 4 are located proximate the lower surface of the shock absorber, just the reverse of the embodiment of FIG. 2.

Figure 6:
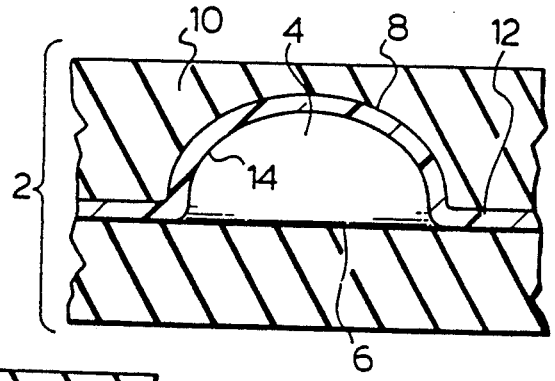
FIG. 6 shows another embodiment of a cell of the membrane of the shock absorber.
Figure 6A:
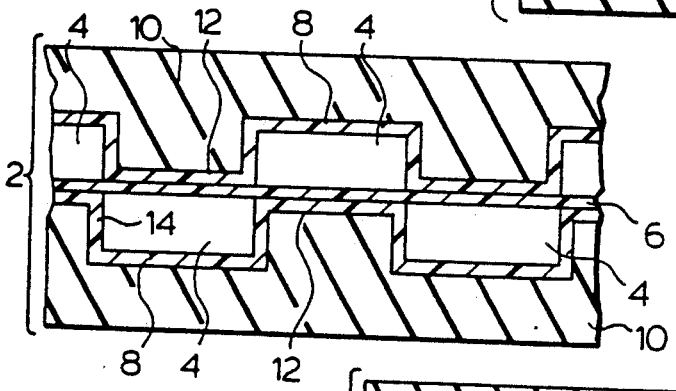
Figure 6B:
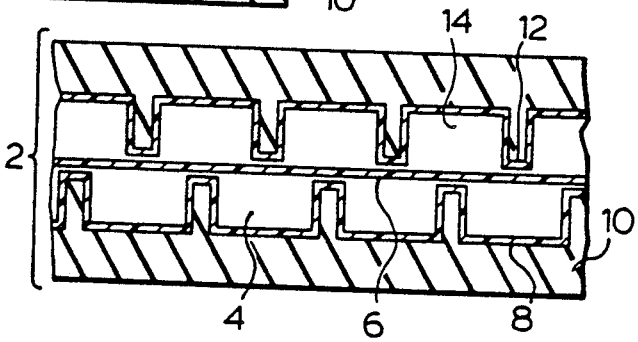

Cells 4 may be any desired shape or size. As shown in FIGS. 1 to 3, cells 4 are generally rectangular in shape. FIG. 4 shows an alternate design for cell 4 which is shown as a helicoidal shape. FIG. 5 shows a spherical shaped cell 4 which has been formed by sealing two hemispherical shaped cells together as shown in FIG. 6. While not shown, the cells 4 may also be pyramidal in shape.

It is also possible that the cells be arranged such that they point upwards or downwards.

If desired, a reinforcing means may be formed directly into the cell wall depending upon the specific shock absorbing requirement and applications of the shock absorber.

Figure 9:
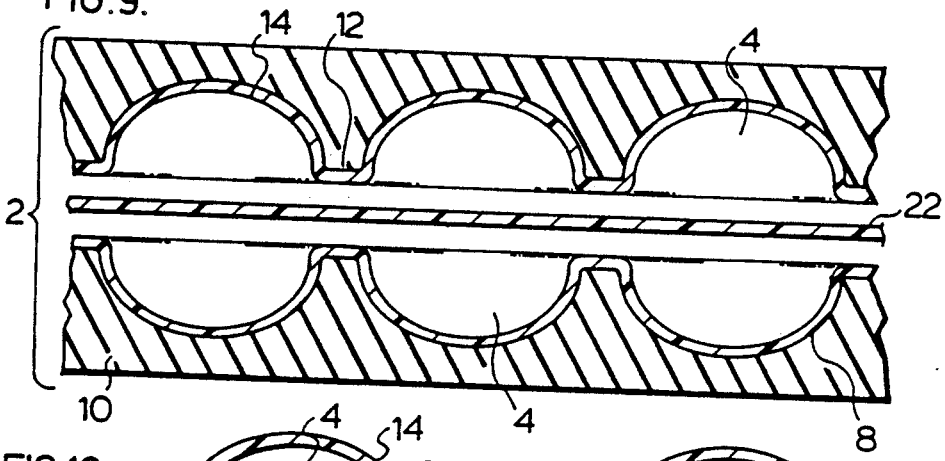
FIG. 9 is a partially sectional view of a portion of a membrane embodying the preferred embodiment of the invention.
Figure 10:
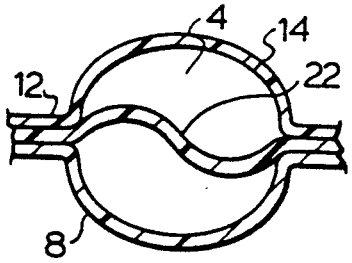
FIG. 10 is a sectional view of one cell showing a preferred embodiment of the cell structure.
Figure 11:
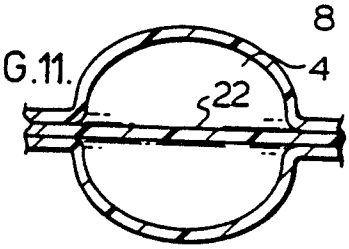
FIG. 11 is a sectional view of one cell showing another embodiment of the cell structure.

A preferred embodiment is illustrated in FIG. 9. In this embodiment, a tensor membrane 22 of an elastomeric material is inserted between the two hemispherical shaped cells 4. The two hemispherical shaped cells 4 are sealed together in the ordinary manner as explained hereinafter with a tensor membrane 22 sealed therebetween. In the sealing process, the tensor membrane 22 within the cell 4 itself may form a wave pattern (sigmoid shape) as illustrated in FIG. 10 or a straight pattern as illustrated in FIG. 11.

In this embodiment, the tensor membrane 22 may act as the sealing member 6 to thus form two hemispherical cells. If a spherical cell is to be created such as shown in FIG. 5, the sealing member 6 may be eliminated between hemispherical halves.

With this preferred embodiment, when compression forces are applied, the cell will deform as before. However, the tensor membrane, in view of its location and elastomeric nature will help pull the cell back to its resting shape, that is, it significantly increases the resiliency of the individual cells. If the tensor membrane is formed as a sigmoid shape, the tensor membrane takes advantage of its formed properties as well as its inherent tensile properties to pull back the cells to their resting state. Thus, the combination of formed properties due to shape and inherent properties due to the elastomeric nature of the material, significantly contribute to the increase in the resiliency and shock absorbing capabilities of the cell.

Also, in the case of a partitional tensor membrane (which acts as a sealing member) the presence of the tensor membrane further restricts air shift within the cell itself thus increasing the functional stability of the multi-cell membrane as a whole.

The tensor membrane may be formed straight (FIG. 11), as a sigmoid (FIG. 10) or a plurality of tensors may be formed in each cell (FIG. 12). They may also be belt-like or as a perforated sheet. The increased number of tensor membranes will speed up the recovery phase of the cell while strengthening its structure.

The limitation is of course the size and shape of the multi-cell membrane itself. While cell dimensions and shapes may vary, the tensor membranes may likewise vary in number and shapes. The limited space inside the shoe sole and shock absorbing requirements may be the controlling factor vis-a-vis the cell and tensor membranes.

The cells may be of different combinations as well as different shapes within the scope of the present invention. For example, the cells may be hemispherical, spherical, spherical with a tensor membrane, or hemispherical with a tensor membrane and the like. Also, the shape and number of tensor membranes may also be varied They may be sigmoid, or, straight, perforated, rectilinear, concentric or partitional.

The two preferred embodiments are illustrated in FIG. 15 and 16. FIG. 15 shows the shock absorber 2 having hemispherical cells 4 divided by a straight tensor membrane 22. FIG. 16 shows the same structure except that tensor membrane 22 is sigmoid in shape.

Figure 7:
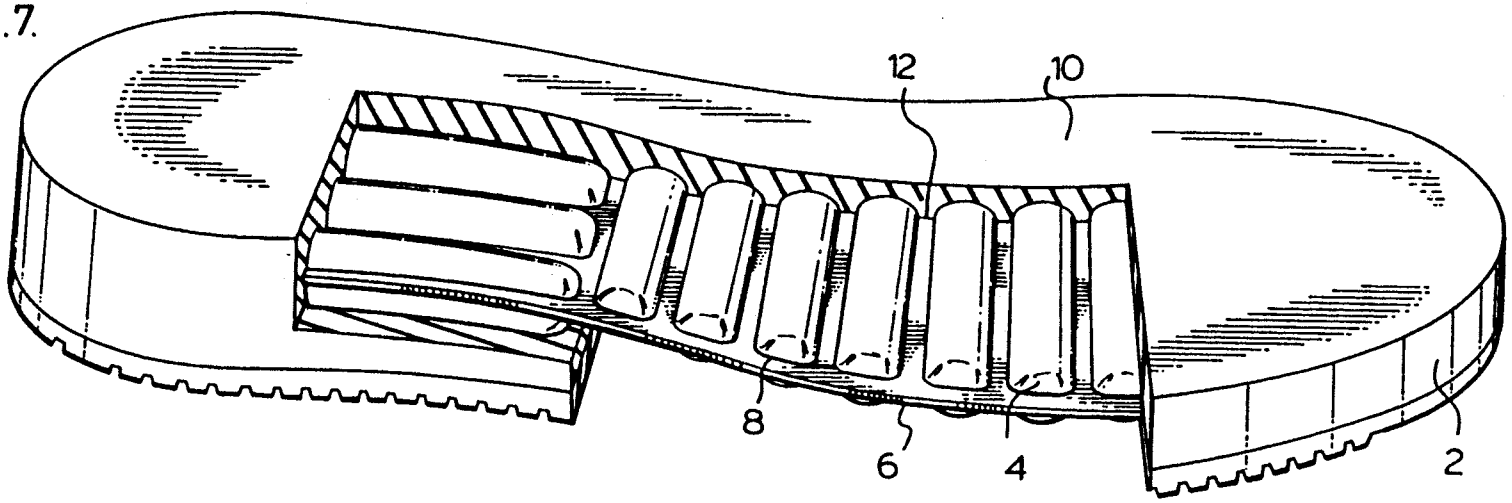
FIG. 7 is a partially cut-away view of the shock absorber of the present invention for use as a midsole.

The shock absorber of the present invention may be used as an insole or as a midsole for a shoe. In designing the specific piece of footwear, the air cell membrane may be located in any desired location, such as under the heel area, under the longitudinal arch area, under the ball of the foot, or any combination therefrom. FIG. 7 illustrates one arrangement of the membrane embedded within an envelope, for use as a midsole in a shoe. In this embodiment, some of the cells 4 are transversely aligned across the mid and forward portion of the midsole with the rear portion of the midsole having longitudinally extending cells.

In determining the structural size and dimensions and location of the cells, various factors must be considered. For example, if the shock absorber is to be used as a midsole in a shoe to be worn by a heavier person, it is preferable that the shoe have increased cushioning. By having spherical cells, and a thick envelope, with the cells covering all of the midsole surface, the desired effect will be achieved. In designing the structure and location of the cells, it must also be remembered that the foot experiences different positive load peaks at different areas during body mass displacement. Therefore, the number and structure of the cells themselves should be designed to be directly aligned with the pressure areas to neutralize and absorb as much impact as possible.

For example, in the case of an insole application, where the space inside the shoe at the front thereof is limited, the cells could be formed hemispherical in shape which will reduce the thickness of the insole while still providing improved shock absorbing characteristics.

It is pointed out that while cells have been described as hemispherical in shape, it is to be understood that it is impossible to produce an independent, interconnected cell which has a completely flat surface. During the formation of the cells, a slight deformation resulting from the pressure of the dies on the flowing material will occur at the contact surfaces of the sealing areas, thus leaving permanent debossed marks on both the sealing surface of the sealing member and the under surface thereof.

The cells may be made by any suitable process and preferably, are vacuum formed, pressure formed or thermoformed directly from a die. An especially preferred material from which the membrane can be made is Hytrel, (a trade mark) from the Dupont Company or any type of synthetic rubber.

Hytrel (trade mark) is a particularly useful material since it demonstrates a low creep value, a high resistance to fatigue, and excellent flexibility. It is a polyester elastomer or high strength rubber.

The membrane may be made by any well known process. One suitable method is to first produce a suitable die from a material such as bronze, brass, copper, steel or the like. The cells and the interconnector are then thermoformed as a unitary piece by a suitable forming process.

After this component is formed, the sealing member is then sealed thus forming the discrete cells. During the sealing process, air is entrapped directly into the cells at ambient temperature and pressure. Such sealing may be effected by pulse sealing, contact sealing, radio frequency sealing or ultrasonic sealing or by other methods such as hot plate welding, electromagnetic bonding, heat sealing or vulcanizing.

Figure 8A:
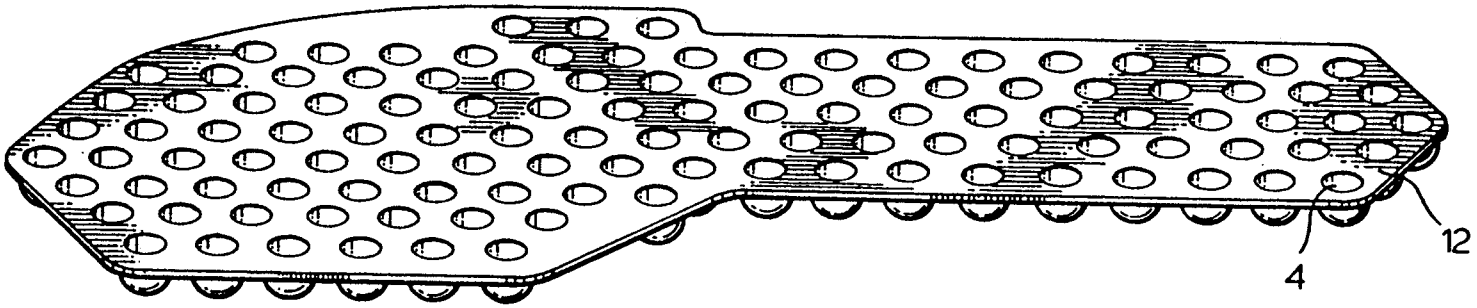
Figure 8C:
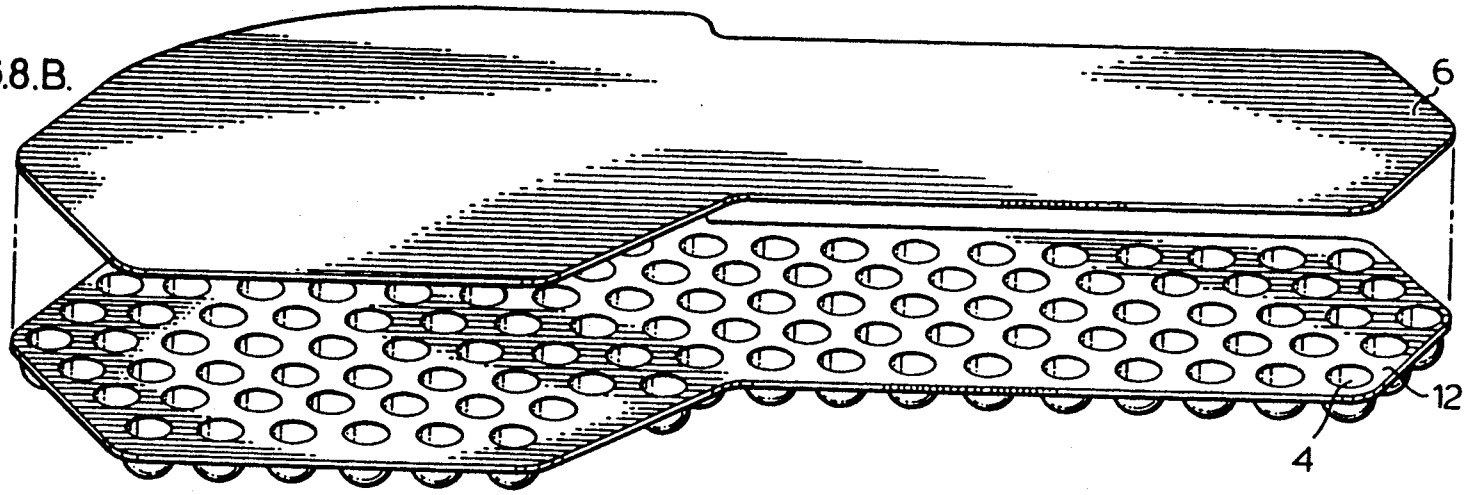
Figure 8C:
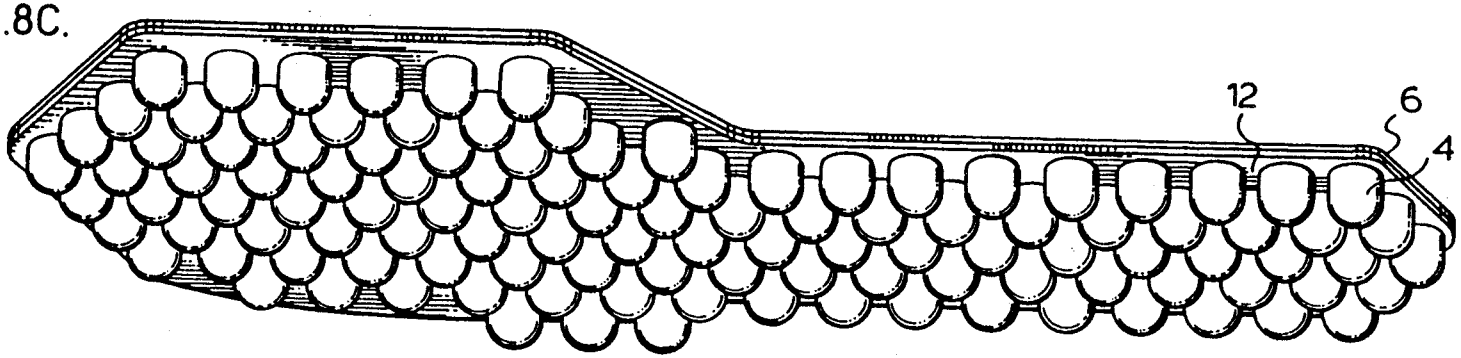

This process is illustrated by FIGS. 8A to 8C. FIG. 8A shows the initial stage of a formed component of the interconnecting member and part of the cells. FIG. 8B shows the sealing member being sealed to the component of FIG. 8A and FIG. 8C shows the multi-cell membrane thus formed.

As the sealing member is sealed to form the discrete cells, air is permanently entrapped within the cells thus producing a membrane having a plurality of discrete, interconnected, non-communicating cells. This membrane, when embedded within the flexible envelope, produces the shock absorbing effects. By trapping the air at ambient pressure and temperature, no increase nor decrease of pressure occurs of the entrapped air within the cells thus stabilizing the air. Since the air is permanently entrapped during the sealing stage, there is no need for any inflating stage thus improving this device over the known art of record.

It is known that because of their porous molecular structure, most elastomeric materials are relatively permeable to air and most gases and fluids in general. Therefore, if the cells were inflated or pressurized above atmospheric pressure, the entrapped air would be lost quickly by diffusion through the cell walls. This problem has been eliminated by using air at ambient pressure This has effectively eliminated the possibility of the failure of the cells when the cells are inflated with air above ambient pressure.

When the load is applied to the cells on the top of the cell and the ground forces react from the bottom of the cell, a "squeezing effect" occurs which tends to flatten the cells and to cause the cell to expand laterally outwardly. As this load increases, causing the internal air pressure to rise, a minute quantity of air will diffuse through the porous cell wall.

It must be remembered that each positive load cycle applied on to the cell represents only a fraction of a second. In the case of a runner, the intensity of each load cycle will increase substantially as the weight of the runner increases. In the case of a person walking or standing, this positive load intensity will be reduced substantially and spread over a longer period of time.

During the neutral phase, that is, when no load is applied, the small quantity of air which was forced out of the cell during the load application stage, will reenter into the cell and return to its original required equilibrium.

By using the tensor membrane 22 as an internal supplementary elastomeric support structure, as illustrated in FIG. 9, the process of reentry of the air is facilitated. The tensor membrane 22 will accelerate the shape recovery phase of each cell. Also, the tensor membrane 22 will reduce the air diffusion loss by exerting a pulling force on each cell when the load is applied. Since the application of the load tends to deform each cell laterally, the membrane 22 tends to resist such deformation thereby increasing the net cushioning effect of each cell by reducing such deformation and air loss.

The cells themselves may vary in shape and size but must have sufficient wall strength so that they will not burst during positive load. For example, it has been found that a cell wall thickness of from about 5 ml to 60 ml is useful, regardless of depth, width or length.

The envelope is moulded or preformed in the desired shape and size by any well known process. It may be compression moulded, open pour molded or cast molded, injection moulded or made by a similar process. The flexible envelope is preferably made from polyurethane in ethylvinylacetate or other suitable foam materials. The envelope may also be made of material other than foam materials such as light density elastomeric rubber materials. The multi-cell membrane may be thus encased inside the flexible envelope during the moulding process or inserted inside the flexible envelope in a recessed pattern which has been compression moulded or cast to accommodate the membrane A preferred density of a suitable foam or non-foam material is 0.15 gm/cc up to about 1.5 gm/cc and a hardness of about 20 to about 80 on the Shore A durometer scale.

It is also possible to first form and seal the multi-cell membrane as outlined hereinbefore, and then to form the flexible envelope directly around the multi-cell membrane by, for example, injection moulding or open casting techniques Thus, the envelope is formed directly around the multi-cell membrane inside a mould.

The purpose of the flexible envelope is to shield the entire outer structure surface of the cells of the shock absorber. Also, the envelope effectively equally disperses the migrating forces which are applied to each cell during the positive load phase. These forces are applied outwardly and laterally onto the wall of each cell; some of the load is applied in between the cells; some of the load is applied to the top wall of each cell; and some of the load is applied vertically.

The shock absorber may also be formed without using the flexible envelope. In this embodiment, the multi-cell membrane is the same as described hereinbefore, and is used directly as an insole or as a midsole of the shoe.

In this embodiment, the multi-cell membrane may be moulded or extruded directly into the shoe as a midsole or an insole Thus, the structure of the multi-cell membrane is identical to that described hereinbefore and int he preferred embodiment, is of the structure as shown in FIG. 10 (or FIGS. 11 and 12).

The multi-cell membrane is designed so that the cells do not communicate with each other. This provides optional stability and benefits from air entrapment at ambient temperature and pressure to eliminate total system failure due to puncture or deflation. Accordingly, the hardness of the flexible envelope is not so critical as to coincide with the compressibility ratio of the independent cells of the membrane. This thus enhances the number of choices of multi-cell membrane/-flexible envelope combinations resulting in better shock absorbency properties.

As stated hereinbefore, the shock absorber of the present invention may be incorporated directly into the midsole of a shoe, or formed as an accessory part of a shoe such as an insole. In use, as a load is applied, some of the entrapped air within the cell will diffuse very slowly outwardly from the cell through the molecular structure of the wall of the cell. When the load is removed, the air will reenter the cell through the cell wall automatically.

This result is partly due to the shape of the thermoformed cell, the structural design, and to the strength and flexibility of the material from which the cells are made. Since the shoe spends much more time in a neutral or resting phase than under load, the possibility of flattening the structure by walking or other forms of activity is virtually impossible.

Further, due to the formation and shape of the cells, and the fact that air is entrapped at ambient temperature and pressure, there is no loss of pressure inside each cell over time and thus, the structure remains functional for the life of the shoe. It is also important to understand that as the load is applied, and the air entrapped inside the cell is compressed, the elastomeric material of the cell wall expands laterally and outwardly and neutralizes the load application. Once the load is neutralized, the material will regain its original shape. By providing an excellent shock absorbing mechanism, the multi-cell membrane demonstrates remarkable stability. This is due to the absence of air shift between the cells. Also, "bottoming out" is effectively prevented by reducing the temporary structural deformation which occurs during load application by the structure and material of the shock absorbing material.

Figure 14A:
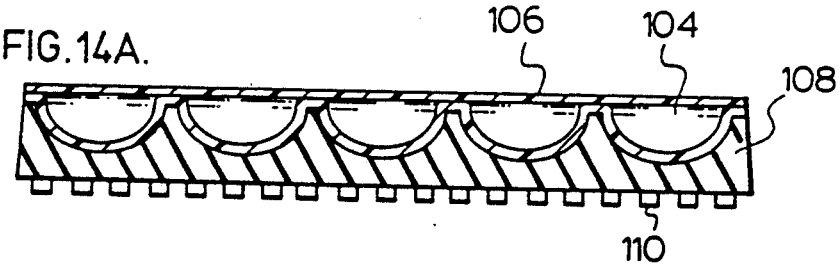
Figure 14B:
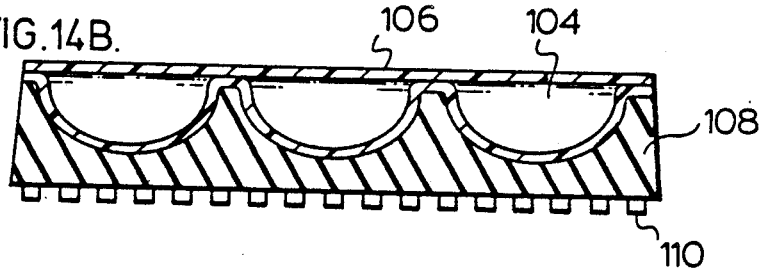
Figure 14C:
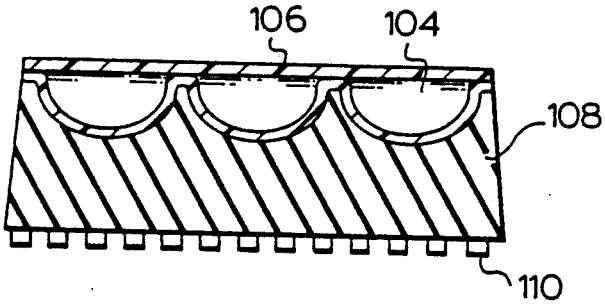

FIG. 13 illustrates a shoe sole to illustrate the placement of the new shock absorbing material. For use as a midsole as shown in FIG. 14*a*, cells 104 are arranged proximate the upper surface 106 of the midsole 108 which is on the top of the outsole 110. As shown in FIG. 14*b*, the air cells 104 are arranged again proximate the upper surface 106 of midsole 108 which is on the top of the outsole 110. Similarly, as shown in FIG. 14*c*, the cells 104 are also arranged proximate the upper surface 106 of the midsole 108.

Figure 14D:
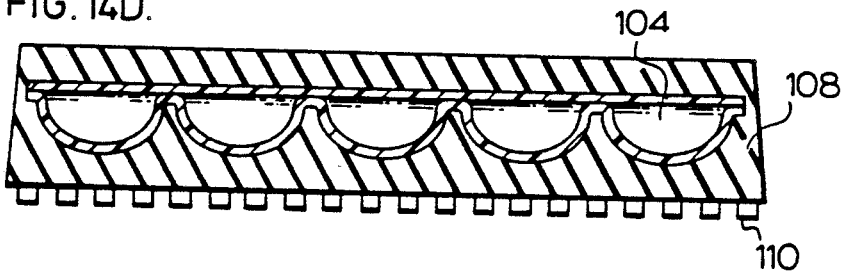
Figure 14E:
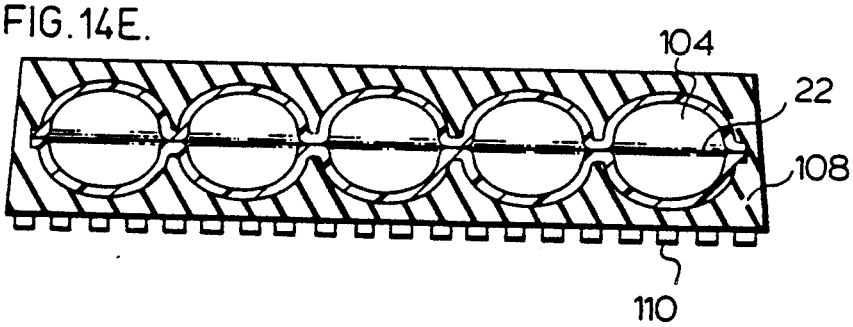

FIG. 14*d* shows another embodiment wherein the cells 104 are arranged inside the midsole 108 on top of outsole 110. FIG. 14*e* shows another embodiment wherein the cells 104 are of a different profile, but imbedded with midsole 108.

FIG. 17 illustrates the manner in which the shock absorber 2 is used in a shoe 24.

Although the invention has been described with reference to a particular embodiment, it is understood that it is not so restricted.

What I claim is:

1. An insole for use in an article of footwear, said insole comprising a synthetic rubber material consisting of a plurality of independent and non-communicating cells, each cell containing air at ambient temperature and pressure, said cells connected by an interconnector, at least one sigmoid shaped tensor membrane extending from one side of each cell through the center of each cell and sealed to another side of said cell.

2. An insole as claimed in claim 1 wherein said cells are spherical, in shape.

3. An insole as claimed in claim 1 wherein said tensor membrane is planar with and sealed to said interconnector.

4. An insole as claimed in claim 1 wherein said tensor membrane divides each cell into two discrete air tight subcells.

5. A midsole for use in an article of footwear, said midsole comprising a synthetic rubber material consisting of a plurality of independent and non-communicating cells, each cell containing air at ambient temperature and pressure, said cells connected by an interconnector, at least one sigmoid shaped tensor membrane extending from one side of each cell through the center of each cell and sealed to another side of said cell.

6. A midsole as claimed in claim 5 wherein said cells are spherical in shape.

7. An midsole as claimed in claim 4 wherein said tensor membrane is planar with and sealed to said interconnector.

8. An insole as claimed in claim 5 wherein said tensor membrane divides each cell into two discrete air tight subcells.

* * * * *